US010417985B2

(12) United States Patent
Zeng

(10) Patent No.: US 10,417,985 B2
(45) Date of Patent: Sep. 17, 2019

(54) DOUBLE-SIDE GATE DRIVER ON ARRAY CIRCUIT, LIQUID CRYSTAL DISPLAY PANEL, AND DRIVING METHOD

(71) Applicant: Shenzhen China Star Optoelectronics Technology Co., Ltd., Shenzhen, Guangdong (CN)

(72) Inventor: Mian Zeng, Guangdong (CN)

(73) Assignee: Shenzhen China Star Optoelectronics Technology Co., Ltd., Shenzhen (CN)

( * ) Notice: Subject to any disclaimer, the term of this patent is extended or adjusted under 35 U.S.C. 154(b) by 28 days.

(21) Appl. No.: 15/500,156

(22) PCT Filed: Jan. 19, 2017

(86) PCT No.: PCT/CN2017/071627
§ 371 (c)(1),
(2) Date: Dec. 22, 2017

(87) PCT Pub. No.: WO2018/040491
PCT Pub. Date: Mar. 8, 2018

(65) Prior Publication Data

US 2018/0211629 A1 Jul. 26, 2018

(30) Foreign Application Priority Data

Aug. 31, 2016 (CN) ..... 2016 1 0797442

(51) Int. Cl.
*G09G 3/36* (2006.01)

(52) U.S. Cl.
CPC ..... *G09G 3/3677* (2013.01); *G09G 3/36* (2013.01); *G09G 2300/0404* (2013.01);
(Continued)

(58) Field of Classification Search
CPC ..... G09G 3/3677; G09G 3/36; G09G 3/3674; G09G 2300/0404; G09G 2300/0408;
(Continued)

(56) References Cited

U.S. PATENT DOCUMENTS 7,522,145 B2 * 4/2009 Lee ..... G02F 1/1345 345/100
2010/0007598 A1 * 1/2010 Chan ..... G09G 3/3677 345/100

(Continued)

FOREIGN PATENT DOCUMENTS

CN 101114005 A 1/2008
CN 103730093 A 4/2014

(Continued)

OTHER PUBLICATIONS

International Search Report dated Jun. 9, 2017 for International Patent Application No. PCT/CN2017/071627.

(Continued)

*Primary Examiner* — Tom V Sheng

(57) ABSTRACT

Disclosed are a double-side gate driver on array circuit, a liquid crystal display panel, and a driving method. A technical problem to be solved is that double-side drive design which includes a GOA circuit unit having two pull-down holding parts cannot meet requirements for narrow-bezel display panel design when a narrow-bezel, large-size display device is manufactured. A solution of the double-side gate driver on array circuit is: GOA units of two opposite sides in a same row share one group of pull-down holding parts.

11 Claims, 4 Drawing Sheets

(52) U.S. Cl.
CPC ..... *G09G 2300/0408* (2013.01); *G09G 2310/0267* (2013.01); *G09G 2310/0281* (2013.01); *G09G 2310/0286* (2013.01); *G09G 2310/08* (2013.01)

(58) Field of Classification Search
CPC ... G09G 2310/0267; G09G 2310/0281; G09G 2310/0283; G09G 2310/0286; G09G 2310/08
See application file for complete search history.

(56) References Cited

U.S. PATENT DOCUMENTS

2010/0085335 A1* 4/2010 Kato ..... G09G 3/3677 345/204
2010/0231497 A1* 9/2010 Liao ..... G09G 3/3677 345/100
2013/0009925 A1* 1/2013 Ueda ..... G02F 1/13454 345/204
2013/0094166 A1* 4/2013 Yokoyama ..... G09G 3/3666 361/784
2014/0320386 A1* 10/2014 Li ..... G09G 3/3677 345/87
2016/0055814 A1* 2/2016 Yang ..... G09G 3/3677 345/213
2016/0118409 A1* 4/2016 Jin ..... H01L 27/124 257/59
2016/0148589 A1* 5/2016 Cao ..... G09G 3/3677 345/208
2017/0243555 A1* 8/2017 Cao ..... G11C 19/28
2017/0243556 A1* 8/2017 Cao ..... G11C 19/28
2018/0047759 A1* 2/2018 Zhao ..... G02F 1/13

FOREIGN PATENT DOCUMENTS

CN 103744206 A 4/2014
CN 104167191 A 11/2014
CN 104966501 A 10/2015
CN 106128401 A 11/2016
JP 2008170993 A 7/2008
KR 20120073793 A 7/2012

OTHER PUBLICATIONS

Chinese Office Action dated Mar. 2, 2018 for Chinese Patent Application No. 201610797442.2.

* cited by examiner

DOUBLE-SIDE GATE DRIVER ON ARRAY CIRCUIT, LIQUID CRYSTAL DISPLAY PANEL, AND DRIVING METHOD

CROSS-REFERENCE TO RELATED APPLICATIONS

This application claims the priority of Chinese patent application CN 201610797442.2, entitled "Double-side gate driver on array circuit, liquid crystal display panel, and driving method" and filed on Aug. 31, 2016, the entirety of which is incorporated herein by reference.

FIELD OF THE INVENTION

The present disclosure relates to the technical field of liquid crystal display, and in particular, to a double-side gate driver on array circuit, a driving method, and a liquid crystal display panel, which are applicable for narrow-bezel design of a display panel.

BACKGROUND OF THE INVENTION

At present, thin film transistor liquid crystal display (TFT-LCD) devices, as main flat display devices in the prior art, have become important display devices in modern IT and video products. Liquid crystal display devices are widely used in various electronic products. During manufacturing of the liquid crystal display devices, there is an important technology, i.e., gate driver on array (GOA) technology. The GOA technology refers to manufacturing a row scanning drive signal circuit of a gate drive circuit on an array substrate of a liquid crystal display panel so as to realize a row by row scanning drive mode of the gate drive circuit. The gate drive circuit integrated on the array substrate by means of the GOA technology is termed a GOA gate drive circuit or a GOA circuit.

An existing GOA circuit generally comprises multiple GOA units in cascade connection. Each stage of GOA unit drives a corresponding stage of horizontal gate line. A GOA unit mainly comprises a pull-up part, a pull-up control part, a transfer part, a key pull-down part, and a pull-down holding part, and a boost capacitor which is configured to boost an electric potential.

The pull-up part is mainly configured to convert a clock signal into a gate signal. The pull-up control part is configured to control turn-on time of the pull-up part, and is generally connected with a transfer signal or a gate signal transmitted from a previous-stage GOA unit. The key pull-down part is configured to pull down a gate signal to a low electric potential as soon as possible, i.e., turn off the gate signal. The pull-down holding part is configured to hold a gate output signal and a gate signal of the pull-up part in a turn-off state (i.e., a negative electric potential). Generally, two pull-down holding parts are provided, and they function alternately. The boost capacitor is configured to boost a voltage at node Q for a second time, which is beneficial for outputting a G(N) signal of the pull-up part.

FIG. 1 schematically shows a GOA circuit in the prior art. An $N^{th}$-stage GOA unit charges an $N^{th}$ horizontal gate line G(N) in an active area. The $N^{th}$-stage GOA unit comprises a pull-up control part 100, a pull-up part 200, a transfer part 300, a key pull-down part 500, a boost capacitor 400, a first pull-down holding part 600 and a second pull-down holding part 700.

The pull-up control part 100 comprises a thin film transistor T11. A gate of the thin film transistor T11 receives a transfer signal ST(N−1) from an $(N-1)^{th}$-stage GOA unit; a drain thereof is connected to an $(N-1)^{th}$ horizontal gate line G(N−1); and a source thereof is connected to a gate signal node Q(N). The pull-up part 200 comprises a thin film transistor T21. A gate of the thin film transistor T21 is connected to the gate signal node Q(N); a drain thereof receives a clock signal CK; and a source thereof is connected to the $N^{th}$ horizontal gate line G(N). The transfer part 300 comprises a thin film transistor T22. A gate of the thin film transistor T22 is connected to the gate signal node Q(N); a drain thereof receives a clock signal CK; and a source thereof outputs a transfer signal ST(N). The key pull-down part 500 comprises a thin film transistor T31. A gate of the thin film transistor T31 is connected to an $(N+1)^{th}$ horizontal gate line G(N+1); a drain thereof is connected to the $N^{th}$ horizontal gate line G(N); and a source thereof is connected to a direct-current low voltage VSS. The key pull-down part 500 further comprises a thin film transistor T41. A gate of the thin film transistor T41 is connected to the $(N+1)^{th}$ horizontal gate line G(N+1); a drain thereof is connected to the gate signal node Q(N); and a source thereof is connected to the direct-current low voltage VSS.

Pull-down holding parts comprises two pull-down holding parts which are symmetrical to each other, i.e., the first pull-down holding part 600 and the second pull-down holding part 700.

During operation, a frequency of a first clock signal LC1 and a frequency of a second clock signal LC2 are lower than that of the clock signal CK input to the pull-up part 200, and a first circuit node P(N) and a second circuit node K(N) are enabled to have a high electric potential alternately, so that the two pull-down holding parts can operate in turns, thereby alleviating unfavorable effects caused when thin film transistors thereof are in a direct-current stress state for a long time.

For a large-size liquid crystal panel, since an RC loading thereof is relatively large, design of double-side drive is generally used, and a structure of the double-side drive is schematically shown in FIG. 2. A GOA circuit is provided on both sides of an active area, and gate driving signals are input to gate lines from both sides thereof. A double-side GOA drive circuit with an existing design is shown in FIG. 1, and each GOA circuit unit thereof comprises two pull-down holding parts.

A "narrow-bezel" television refers to a television having no obvious bezel covering a display panel of a display device thereof, so that the television has a simple and fashionable appearance. The "narrow-bezel" television has become a development trend of liquid crystal televisions by virtue of its simple and fashionable appearance.

However, the design of double-side drive of the GOA circuit unit having two pull-down holding parts cannot meet requirements for design of a narrow-bezel display panel because the GOA circuit unit has a large-size structure. Therefore, on the premise of meeting GOA drive requirements, an urgent problem to be solved is how to reduce a structure size of the GOA circuit unit as much as possible.

SUMMARY OF THE INVENTION

The present disclosure aims to solve an existing problem that when design of double-side drive of a GOA circuit unit having two pull-down holding parts is used to manufacture a narrow-bezel, large-size display device, requirements for design of a narrow-bezel display panel cannot be met because the GOA circuit unit has a large-size structure.

According to one aspect of the present disclosure, a double-side GOA circuit is provided. GOA units of two opposite sides in a same row share one group of pull-down holding parts.

Preferably, a clock signal of a pull-down holding part is a high-frequency CK signal or a high-frequency XCK signal having an opposite phase to the high-frequency CK signal. A clock signal of a pull-down holding part in an odd row on a left side and a clock signal of a pull-down holding part in an even row on a right side have a same electric potential, and a clock signal of a pull-down holding part in an odd row and a clock signal of a pull-down holding part in an even row on a same side have different electric potentials.

Preferably, multiple GOA units having a same structure are arranged on a left side and a right side respectively. Each stage of GOA unit comprises a pull-up control part, a pull-up part, a transfer part, a boost capacitor, a key pull-down part, and a pull-down holding part.

Preferably, each stage of GOA unit further comprises a switching element T72, which is configured to pull down a gate output signal of a previous-stage GOA unit together with the pull-down holding part.

Preferably, the switching element is a metal oxide field effect transistor.

According to another aspect of the present disclosure, a liquid crystal display panel, which comprises a preceding double-side GOA circuit, is provided.

According to another aspect of the present disclosure, a display device, which comprises a preceding liquid crystal display panel, is provided.

According to another aspect of the present disclosure, a double-side GOA circuit driving method is provided. The double-side GOA method comprises steps of: providing multiple stages of GOA units having a same structure on a left side and a right side; and providing a pull-down holding part in each stage of GOA unit. A GOA unit on the left side and a GOA unit on the right side in a same row share one group of pull-down holding parts. An electric potential of a clock signal of the GOA unit on the left side is complementary to an electric potential of a clock signal of the GOA unit on the right side, and an electric potential of a clock signal of a pull-down holding part in an odd row is complementary to an electric potential of a clock signal of a pull-down holding part in an even row on a same side.

Preferably, a clock signal of a pull-down holding part is a high-frequency CK signal or a high-frequency XCK signal having an opposite phase to the high-frequency CK signal.

Preferably, a switching element T72 cooperates with the pull-down holding part to pull down a gate output signal of a previous-stage GOA unit.

Compared with the prior art, the above solution has the following advantages or beneficial effects.

According to the present disclosure, with respect to each stage of GOA drive unit, one pull-down holding part can be saved, and each stage of GOA drive unit share one group of pull-down holding parts with a GOA drive unit on an opposite side in a same row. An operating state of the GOA drive unit can be controlled by setting the electric potential of the clock signal so as to perform a pull-down holding function.

A size of the double-side GOA circuit can be reduced to a large degree without influencing functions thereof, so that a bezel of a panel comprising the double-side GOA circuit can be reduced, which is favorable for narrow-bezel design.

The above technical features can be combined with one another in various suitable manners or be replaced by equivalent technical features, as long as the objective of the present disclosure can be achieved.

BRIEF DESCRIPTION OF THE DRAWINGS

The present disclosure will be described in detail based on the embodiments and with reference to the accompanying drawings hereinafter. In the drawings.

In the accompanying drawings, same components are represented by same reference signs. The accompanying drawings are not drawn according to actual proportions.

DETAILED DESCRIPTION OF THE EMBODIMENTS

The present disclosure will be further explained in details with reference to the accompanying drawings hereinafter.

In the prior art, a double-side drive method is generally used in designing a GOA drive circuit of a narrow-bezel display device. Since an existing GOA circuit unit has a large-size structure, a display device has a defect that a bezel thereof is not narrow enough. The present disclosure provides a small-size GOA drive circuit and a liquid crystal panel comprising the small-size GOA drive circuit.

Embodiment 1

Figure 3:
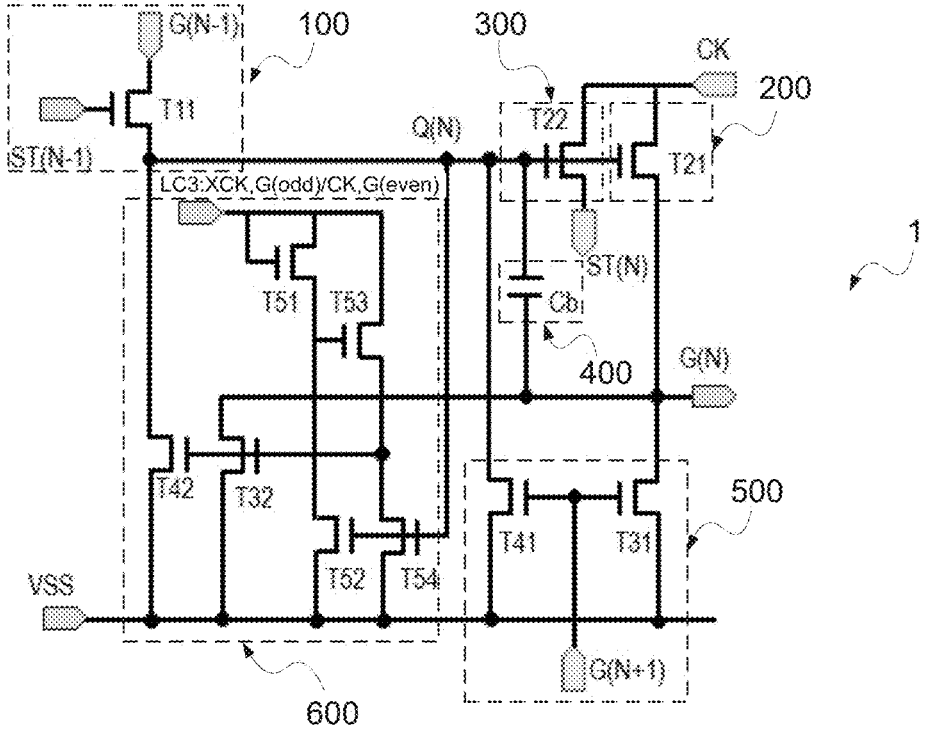
FIG. 3 schematically shows a circuit of a GOA drive unit (on a right side) in embodiment 1 of the present disclosure.
Figure 4:
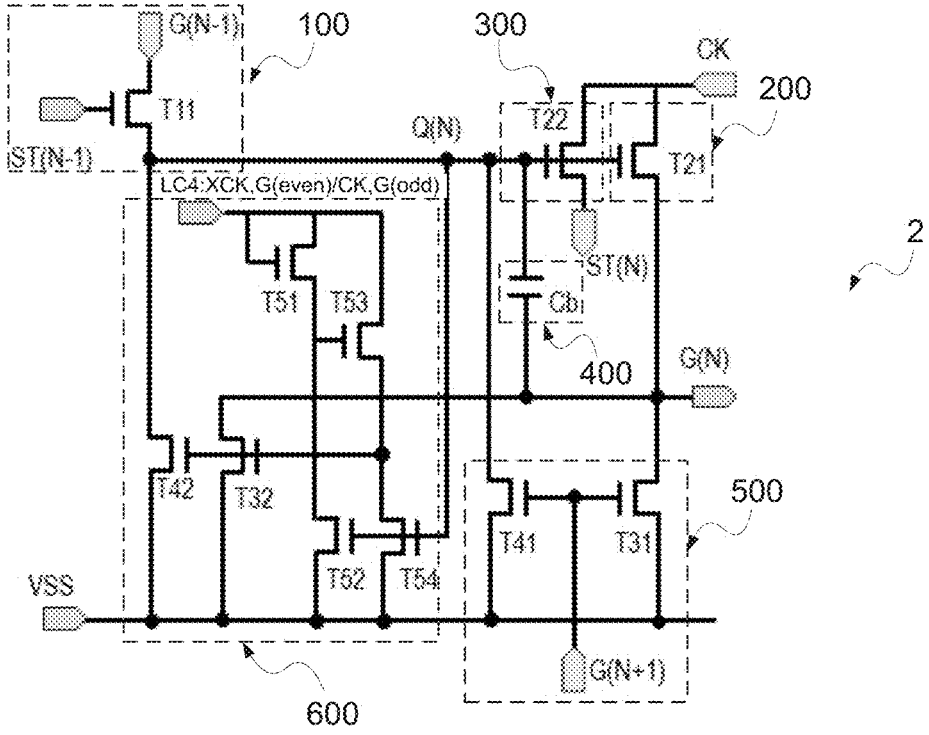
FIG. 4 schematically shows a circuit of a GOA drive unit (on a left side) in embodiment 1 of the present disclosure.

FIG. 3 and FIG. 4 schematically show a principle of a GOA drive circuit in embodiment 1 of the present disclosure.

A double-side GOA drive circuit is used for manufacture of a narrow-bezel liquid crystal display panel. A central portion of the narrow-bezel liquid crystal display panel is an active area. A right portion of the narrow-bezel liquid crystal display panel is provided with multiple stages of GOA drive units (right side) 2, and FIG. 3 shows a circuit of an $N^{th}$-stage GOA drive unit on a right side. A left portion of the narrow-bezel liquid display panel is provided with multiple stages of GOA drive units (left side) 1, and FIG. 4 shows a circuit of an $N^{th}$-stage GOA drive unit on a left side. A GOA drive unit 2 and a GOA drive unit 1 have a same structure, and they cooperate to drive the display panel. Each stage of GOA drive unit comprises a pull-up control part 100, a pull-up part 200, a transfer part 300, a boost capacitor 400, a key pull-down part 500, and a pull-down holding part 600.

The pull-up part 200 comprises a switching element T21. A gate of the switching element T21 is connected to a gate signal node Q(N); a drain thereof receives a clock signal CK; and a source thereof is connected to an $N^{th}$ horizontal gate line G(N). The pull-up part 200 is mainly configured to convert a clock signal into a gate signal.

The pull-up control part 100 comprises a switching element T11. A gate of the switching element T11 receives a transfer signal ST(N−1) from an $(N-1)^{th}$-stage GOA drive unit on a same side, a drain thereof is connected to an $(N-1)^{th}$ horizontal gate line G(N−1) on the same side; and a source thereof is connected to the gate signal node Q(N). The pull-up control part 100 is configured to control turn-on time of the pull-up part 200, and receives a transfer signal or a gate signal transmitted from a previous-stage GOA drive unit.

The key pull-down part 500 comprises a switching element T31. A gate of the switching element T31 is connected to an $(N+1)^{th}$ horizontal gate line G(N+1); a drain thereof is connected to the $N^{th}$ horizontal gate line G(N); and a source thereof is connected to a direct-current low voltage VSS. The key pull-down part 500 further comprises a switching element T41. A gate of the switching element T41 is connected to the $(N+1)^{th}$ horizontal gate line G(N+1); a drain thereof is connected to the gate signal node Q(N); and a source thereof is connected to the direct-current low voltage VSS. The key pull-down part 500 is configured to pull down the gate signal to a low electric potential, i.e., to turn off the gate signal.

The transfer part 300 comprises a switching element T22. A gate of the switching element T22 is connected to the gate signal node Q(N); a drain thereof receives a clock signal CK; and a source thereof outputs a transfer signal ST(N).

The boost capacitor 400 is shown as Cb in FIGS. 3 and 4.

In a same row, pull-down holding parts 600 of two sides are symmetrical to each other.

A pull-down holding part on the right side receives a clock signal LC3, and a pull-down holding part on the left side receives a clock signal LC4.

During operation, a frequency of a first clock signal LC3 and a frequency of a second clock signal LC4 are lower than a frequency of the clock signal CK input to the pull-up part, and a first node K(N) and a second node P(N) are enabled to be in a high electric potential alternately, so that two pull-down holding parts operate in turns.

The pull-down holding part comprises a switching element T32, a switching element T42, a switching element T51, a switching element T52, a switching element T53, and a switching element T54.

A drain of the switching element T42 is connected to the gate signal node Q(N); a source thereof is connected to the direct-current low voltage VSS; and a gate thereof is connected to a gate of the switching element T32, a source of the switching element T53, and a drain of the switching element T54.

A drain of the switching element T32 is connected to the $N^{th}$ horizontal gate line G(N), and a source thereof is connected to the direct-current low voltage VSS.

A drain of the switching element T53 is connected to the first clock signal LC3 or the second clock signal LC4, and a gate thereof is connected to a source of the switching element T51 and a drain of the switching element T52.

A drain and a gate of the switching element T51 are connected to the first clock signal LC3 or the second clock signal LC4.

A gate of the switching element T52 is connected to the gate signal node Q(N), and a source thereof is connected to the direct-current low voltage VSS.

A gate of the switching element T54 is connected to the gate signal node Q(N), and a source thereof is connected to the direct-current low voltage VSS.

A pull-down holding part 600 on the left side and a pull-down holding part 600 on the right side in a same row constitute one group of pull-down holding parts 600, which is configured to hold a gate output signal and a gate signal of the pull-up part at a turn-off state (i.e., at a negative electric potential). Two pull-down holding parts 600 operate alternately. The boost capacitor Cb is configured to boost a voltage at the node Q for a second time, which is favorable for outputting of the $N^{th}$ horizontal gate line G(N) of the pull-up part.

Based on a GOA circuit in the prior art, in order to reduce a structure size, only one pull-down holding part 600 is kept in each stage of GOA drive unit in the present embodiment. In order to ensure a pull-down holding function of the GOA drive unit, a drive signal of the pull-down holding part 600 is changed to a high-frequency CK signal or a high-frequency XCK signal having an opposite phase to the CK signal. A GOA drive unit on the left side and a GOA drive unit on the right side in a same row share one group of pull-down holding parts 600. That is, if a GOA drive unit in an odd row on the left side uses a CK signal to drive one pull-down holding part 600 in a same stage, a GOA drive unit in the same odd row on the right side uses an XCK signal (an electric potential thereof is complementary to an electric potential of the CK signal) to drive the other pull-down holding part 600. Likewise, a GOA drive unit in an even row on the left side uses an XCK signal (an electric potential thereof is complementary to an electric potential of a CK signal) to drive one pull-down holding part 600 of the GOA drive unit in the same stage, and a GOA drive unit in the same even row on the right side uses the CK signal to drive the other pull-down holding part 600 of the GOA drive unit in the same stage.

Figure 1:
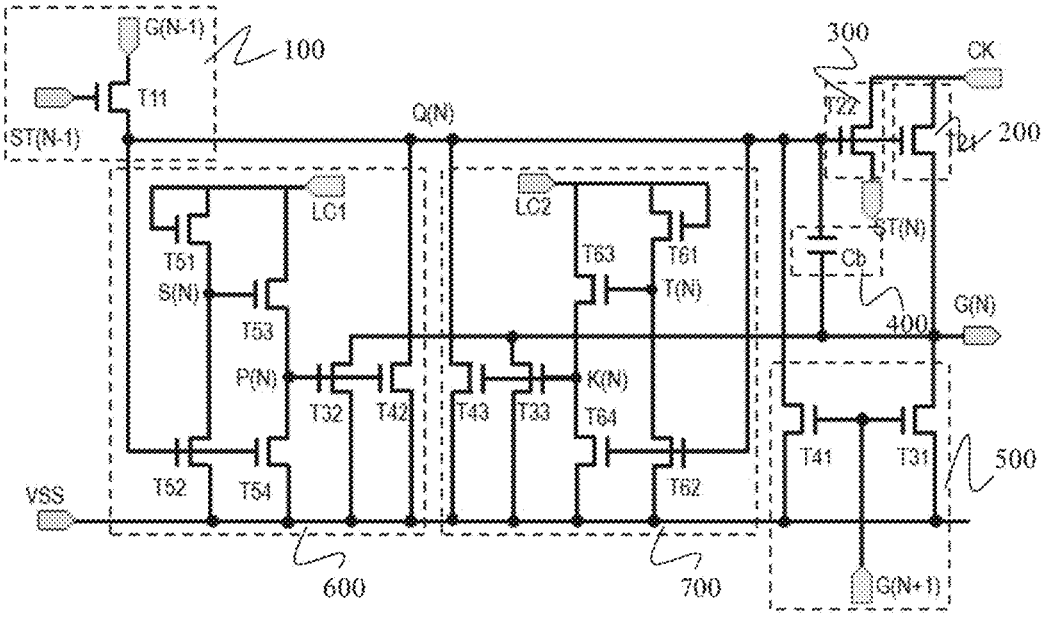
Fig. 1 (Prior Art)
FIG. 1 schematically shows a circuit of a GOA drive unit in the prior art.
Figure 2:
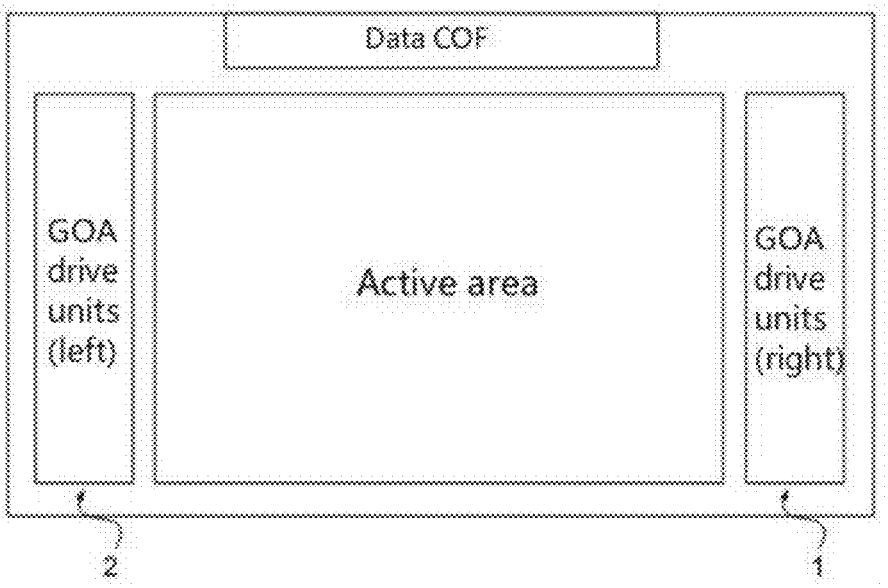
Fig. 2 (Prior art)
FIG. 2 schematically shows a layout of a double-side GOA drive display device.
Figure 7:
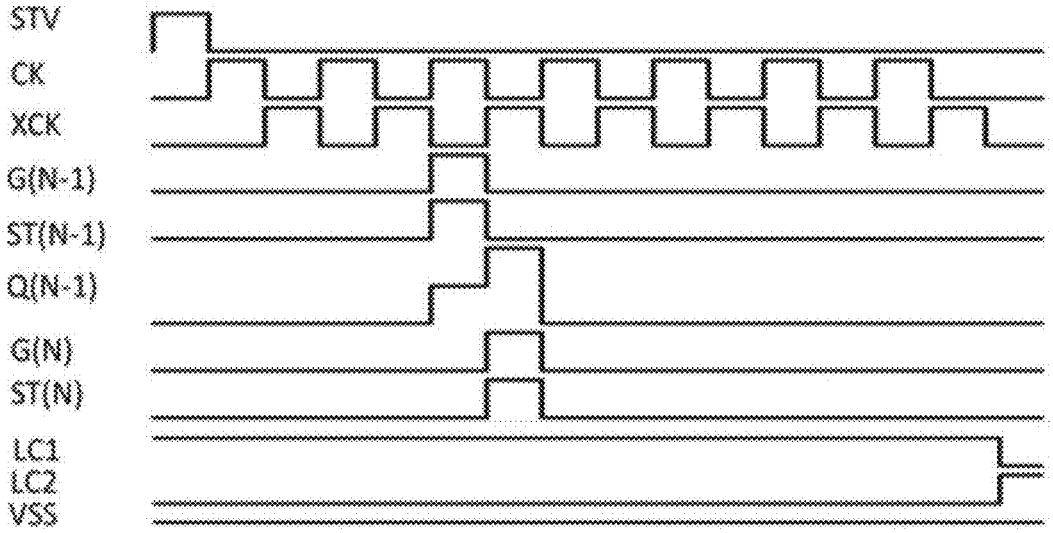
FIG. 7 schematically shows waveforms of signals of a GOA drive circuit.

Waveforms of signals of a circuit formed by the GOA drive unit in the present embodiment are shown in FIG. 7. A waveform of the first clock signal LC1 and a waveform of the second clock signal LC2 in the circuit of FIG. 1 mentioned in the background of the invention are respectively a constant high electric potential and a constant low electric potential, which are complementary to each other. According to the present embodiment, the CK signal and the XCK signal not only have complementary waveforms, but also are high-frequency square waves with a duty cycle of 1. One group of pull-down holding parts in the same row receives CK and XCK clock signals.

Based on the above analysis, it can be seen that the double-side GOA drive circuit of the present embodiment can bring about the following beneficial effects.

Each pull-down holding part 600 has many electronic elements, and one double-side GOA drive unit can save a space of one group of pull-down holding parts 600 (i.e., two pull-down holding parts 600) without influencing functions thereof. Thus, it can be seen that a size of the GOA drive circuit in the present embodiment can be reduced effectively, which is favorable for design of a narrow-bezel panel.

Embodiment 2

Figure 5:
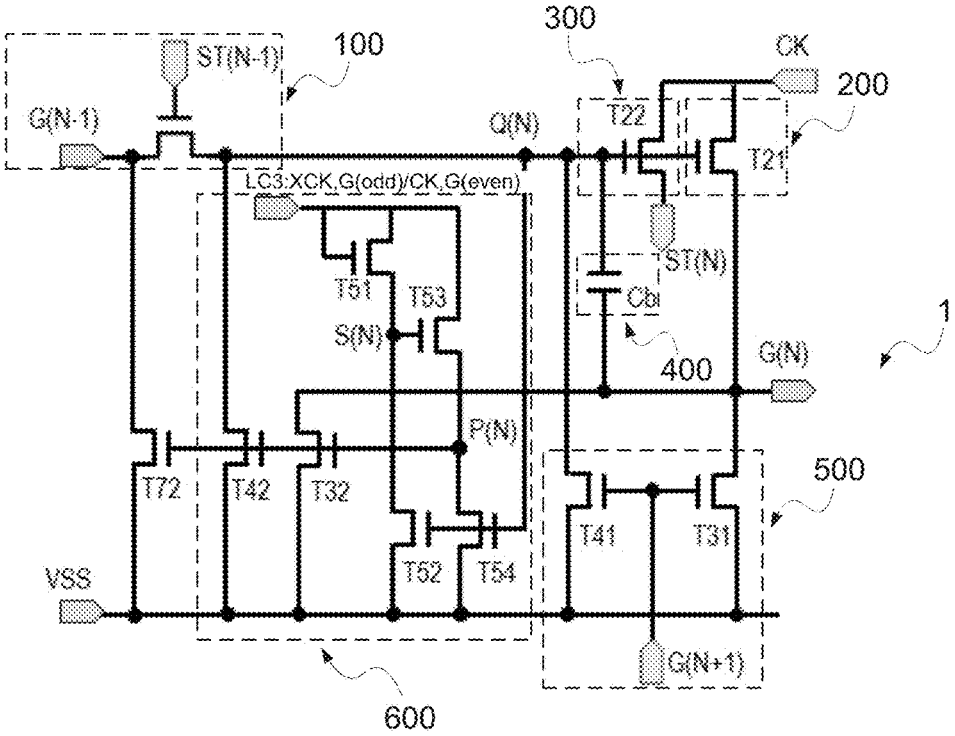
FIG. 5 schematically shows a circuit of a GOA drive unit (on a right side) in embodiment 2 of the present disclosure.
Figure 6:
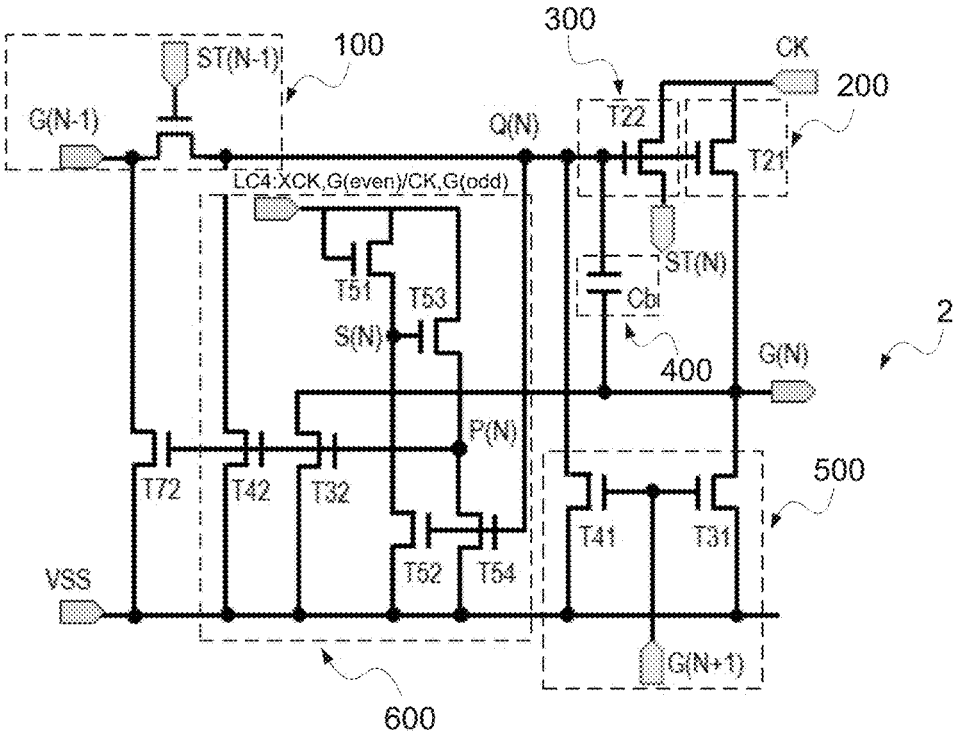
FIG. 6 schematically shows a circuit of a GOA drive unit (on a left side) in embodiment 2 of the present disclosure.

FIG. 5 and FIG. 6 schematically show a principle of a GOA drive circuit in embodiment 2 of the present disclosure.

A double-side GOA drive circuit is used for manufacture of a narrow-bezel liquid crystal display panel. A central portion of the narrow-bezel liquid crystal display panel is an active area. A right portion of the narrow-bezel liquid crystal display panel is provided with multiple stages of GOA drive units (right side) 2, and FIG. 5 shows a circuit of an $N^{th}$-stage GOA drive unit on a right side. A left portion of the narrow-bezel liquid display panel is provided with multiple stages of GOA drive units (left side) 1, and FIG. 6 shows a circuit of an $N^{th}$-stage GOA drive unit on a left side. A GOA drive unit 2 and a GOA drive unit 1 have a same structure, and they cooperate to drive the display panel. Each stage of GOA drive unit comprises a pull-up control part 100, a pull-up part 200, a transfer part 300, a boost capacitor 400, a key pull-down part 500, a pull-down holding part 600, and a switching element T72.

The pull-up part 200 comprises a switching element T21. A gate of the switching element T21 is connected to a gate signal node Q(N); a drain thereof receives a clock signal CK; and a source thereof is connected to an $N^{th}$ horizontal gate line G(N). The pull-up part 200 is mainly configured to convert a clock signal into a gate signal.

The pull-up control part 100 comprises a switching element T11. A gate of the switching element T11 receives a transfer signal ST(N−1) from an $(N-1)^{th}$-stage GOA drive unit on a same side; a drain thereof is connected to an $(N-1)^{th}$ horizontal gate line G(N−1) on the same side; and a source thereof is connected to the gate signal node Q(N). The pull-up control part 100 is configured to control turn-on time of the pull-up part 200, and receives a transfer signal or a gate signal transmitted from a previous-stage GOA drive unit.

The key pull-down part 500 comprises a switching element T31. A gate of the switching element T31 is connected to an $(N+1)^{th}$ horizontal gate line G(N+1); a drain thereof is connected to the $N^{th}$ horizontal gate line G(N); and a source thereof is connected to a direct-current low voltage VSS. The key pull-down part 500 further comprises a switching element T41. A gate of the switching element T41 is connected to the $(N+1)^{th}$e horizontal gate line G(N+1); a drain thereof is connected to the gate signal node Q(N); and a source thereof is connected to the direct-current low voltage VSS. The key pull-down part 500 is configured to pull down the gate signal to a low electric potential, i.e., to turn off the gate signal.

The transfer part 300 comprises a switching element T22. A gate of the switching element T22 is connected to the gate signal node Q(N); a drain thereof receives a clock signal CK; and a source thereof outputs a transfer signal ST(N).

The boost capacitor 400 is shown as Cb in FIGS. 5 and 6.

In a same row, pull-down holding parts 600 of two sides are symmetrical to each other.

A pull-down holding part on the right side receives a clock signal LC3, and a pull-down holding part on the left side receives a clock signal LC4.

During operation, a frequency of a first clock signal LC3 and a frequency of a second clock signal LC4 are lower than a frequency of the clock signal CK input to the pull-up part, and a first node K(N) and a second node P(N) are enabled to be in a high electric potential alternately, so that two pull-down holding parts operate in turns.

The pull-down holding part comprises a switching element T32, a switching element T42, a switching element T51, a switching element T52, a switching element T53, and a switching element T54.

A drain of the switching element T42 is connected to the gate signal node Q(N); a source thereof is connected to the direct-current low voltage VSS; and a gate thereof is connected to a gate of the switching element T32, a source of the switching element T53, and a drain of the switching element T54.

A drain of the switching element T32 is connected to the $N^{th}$-stage horizontal gate line G(N), and a source thereof is connected to the direct-current low voltage VSS.

A drain of the switching element T53 is connected to the first clock signal LC3 or the second clock signal LC4, and a gate thereof is connected to a source of the switching element T51 and a drain of the switching element T52.

A drain and a gate of the switching element T51 are connected to the first clock signal LC3 or the second clock signal LC4.

A gate of the switching element T52 is connected to the gate signal node Q(N), and a source thereof is connected to the direct-current low voltage VSS.

A gate of the switching element T54 is connected to the gate signal node Q(N), and a source thereof is connected to the direct-current low voltage VSS.

A pull-down holding part 600 on the left side and a pull-down holding part 600 on the right side in a same row constitute one group of pull-down holding parts 600, which is configured to hold a gate output signal and a gate signal of the pull-up part at a turn-off state (i.e., at a negative electric potential). Two pull-down holding parts 600 operate alternately. The boost capacitor Cb is configured to boost a voltage at the node Q for a second time, which is favorable for outputting of the $N^{th}$ horizontal gate line G(N) of the pull-up part.

Based on a GOA circuit in the prior art, in order to reduce a structure size, only one pull-down holding part 600 is kept in each stage of GOA drive unit in the present embodiment. In order to ensure a pull-down holding function of the GOA drive unit, a drive signal of the pull-down holding part 600 is changed to a high-frequency CK signal or a high-frequency XCK signal having an opposite phase to the CK signal. A GOA drive unit on the left side and a GOA drive unit on the right side in a same row share one group of pull-down holding parts 600. That is, if a GOA drive unit in an odd row on the left side uses a CK signal to drive one pull-down holding part 600 in a same stage, a GOA drive unit in the same odd row on the right side uses an XCK signal (an electric potential thereof is complementary to an electric potential of the CK signal) to drive the other pull-down holding part 600. Likewise, a GOA drive unit in an even row on the left side uses an XCK signal (an electric potential thereof is complementary to an electric potential of a CK signal) to drive one pull-down holding part 600 of the GOA drive unit in the same stage, and a GOA drive unit in the same even row on the right side uses the CK signal to drive the other pull-down holding part 600 of the GOA drive unit in the same stage.

Compared with embodiment 1, the switching element T72 is added according to the present embodiment. A drain of the switching element T72 is connected to the drain of the switching element T11, and a source thereof is connected to the direct-current voltage VSS.

The switching element T72 cooperates with the pull-down holding part to pull down a gate output signal of the previous-stage GOA drive unit.

Waveforms of signals of a circuit formed by the GOA drive unit in the present embodiment are shown in FIG. 7. A waveform of the first clock signal LC1 and a waveform of the second clock signal LC2 in the circuit of FIG. 1 mentioned in the background of the invention are respectively a constant high electric potential and a constant low electric potential, which are complementary to each other. According to the present embodiment, the CK signal and the XCK signal not only have complementary waveforms, but also are high-frequency square waves with a duty cycle of 1. One group of pull-down holding parts in the same row receives CK and XCK clock signals.

Based on the above analysis, it can be seen that the double-side GOA drive circuit of the present embodiment can bring about the following beneficial effects.

Each pull-down holding part 600 has many electronic elements, and one double-side GOA drive unit can save a space of one group of pull-down holding parts 600 (i.e., two pull-down holding parts 600) without influencing functions thereof. Thus, it can be seen that a size of the GOA drive circuit in the present embodiment can be reduced effectively, which is favorable for design of a narrow-bezel panel.

Only one pull-down transistor is added based on the circuit of embodiment 1, and a better pull-down effect can be obtained without increasing a size of the GOA drive unit.

Although the present disclosure is described hereinabove with reference to specific embodiments, it can be understood that, these embodiments are merely examples of the principles and applications of the present disclosure. Hence, it can be understood that, numerous modifications can be made to the embodiments, and other arrangements can be made, as long as they do not go beyond the spirit and scope of the present disclosure as defined by the appended claims. It can be understood that, different dependent claims and features described herein can be combined in a manner different from those described in the initial claims. It can also be understood that, the technical features described in one embodiment can also be used in other embodiments.

The invention claimed is:

1. A double-side GOA circuit, wherein GOA units of two opposite sides in a same row share one group of pull-down holding parts;

a clock signal of a pull-down holding part is a high-frequency CK signal or a high-frequency XCK signal having an opposite phase to the high-frequency CK signal, and wherein a clock signal of a pull-down holding part in an odd row on a left side and a clock signal of a pull-down holding part in an even row on a right side have a same electric potential, and a clock signal of a pull-down holding part in an odd row and a clock signal of a pull-down holding part in an even row on a same side have different electric potentials.

2. The double-side GOA circuit according to claim 1, wherein multiple GOA units having a same structure are arranged on a left side and a right side respectively, wherein each stage of GOA unit comprises a pull-up control part, a pull-up part, a transfer part, a boost capacitor, a key pull-down part, and a pull-down holding part.

3. The double-side GOA circuit according to claim 2, wherein each stage of GOA unit further comprises a switching element, which is configured to pull down a gate output signal of a previous-stage GOA unit together with the pull-down holding part.

4. The double-side GOA circuit according to claim 3, wherein the switching element is a metal oxide field effect transistor.

5. A liquid crystal display panel, comprising a double-side GOA circuit, wherein in the double-side GOA circuit, GOA units of two opposite sides in a same row share one group of pull-down holding parts;

a clock signal of a pull-down holding part is a high-frequency CK signal or a high-frequency XCK signal having an opposite phase to the high-frequency CK signal, and wherein a clock signal of a pull-down holding part in an odd row on a left side and a clock signal of a pull-down holding part in an even row on a right side have a same electric potential, and a clock signal of a pull-down holding part in an odd row and a clock signal of a pull-down holding part in an even row on a same side have different electric potentials.

6. The liquid crystal display panel according to claim 5, wherein multiple GOA units having a same structure are arranged on a left side and a right side respectively, wherein each stage of GOA unit comprises a pull-up control part, a pull-up part, a transfer part, a boost capacitor, a key pull-down part, and a pull-down holding part.

7. The liquid crystal display panel according to claim 6, wherein each stage of GOA unit further comprises a switching element, which is configured to pull down a gate output signal of a previous-stage GOA unit together with the pull-down holding part.

8. The liquid crystal display panel according to claim 7, wherein the switching element is a metal oxide field effect transistor.

9. A double-side GOA circuit driving method, comprising steps of:

providing multiple stages of GOA units having a same structure on a left side and a right side; and providing a pull-down holding part in each stage of GOA unit, wherein a GOA unit on the left side and a GOA unit on the right side in a same row share one group of pull-down holding parts, and Wherein an electric potential of a clock signal of the GOA unit on the left side is complementary to an electric potential of a clock signal of the GOA unit on the right side, and an electric potential of a clock signal of a pull-down holding part in an odd row is complementary to an electric potential of a clock signal of a pull-down holding part in an even row on a same side.

10. The driving method according to claim 9, wherein a clock signal of a pull-down holding part is a high-frequency CK signal or a high-frequency XCK signal having an opposite phase to the high-frequency CK signal.

11. The driving method according to claim 9, wherein a switching element cooperates with the pull-down holding part to pull down a gate output signal of a previous-stage GOA unit.

* * * * *